United States Patent [19]

Fogelson

[11] Patent Number: 4,458,390

[45] Date of Patent: Jul. 10, 1984

[54] DEMOUNTABLE BELT BUCKLE

[75] Inventor: Arthur I. Fogelson, White Plains, N.Y.

[73] Assignee: Remington Products, Inc., Bridgeport, Conn.

[21] Appl. No.: 380,506

[22] Filed: May 21, 1982

[51] Int. Cl.[3] ..... A44B 11/06; A44B 11/24

[52] U.S. Cl. ..... 24/182; 24/191

[58] Field of Search ..... 24/191, 188, 185, 182, 24/178, 165, 265 A, 192

[56] References Cited

U.S. PATENT DOCUMENTS

| | | | |
|---|---|---|---|
| 1,220,533 | 3/1917 | Nettleton | 24/265 A |
| 1,969,582 | 8/1934 | Rosenblum | 24/182 |
| 2,219,756 | 10/1940 | Sokolof | 24/182 |
| 2,233,883 | 3/1941 | Buchsbaum | 24/191 |
| 2,634,481 | 4/1953 | Katzman | 24/191 |
| 2,634,482 | 4/1953 | Marino | 24/191 |
| 3,191,253 | 6/1965 | Stevenson | 24/191 |
| 3,213,502 | 10/1965 | Albiniano | 24/191 |
| 3,384,936 | 5/1968 | Sokoloff | 24/191 |

FOREIGN PATENT DOCUMENTS

| | | | |
|---|---|---|---|
| 1170182 | 5/1964 | Fed. Rep. of Germany | 24/265.1 |
| 236397 | of 1925 | United Kingdom | 24/182 |
| 769717 | 3/1957 | United Kingdom | 24/191 |

*Primary Examiner*—Paul J. Hirsch
*Assistant Examiner*—John Weiss

[57] ABSTRACT

A belt buckle has a retainer member and a belt gripping member. The retainer member is demountably coupled to a belt segment and the gripping member is demountably coupled to the retainer member. A slot with stop is provided on the retainer member. The slot receives an end segment of the belt which is inserted therein, and, the stop limits entry of the end segment in the slot. A manually actuated clamp is mounted to the retainer member for both clamping the belt segment and for locking the belt gripping member to the retainer member with a single motion.

5 Claims, 6 Drawing Figures

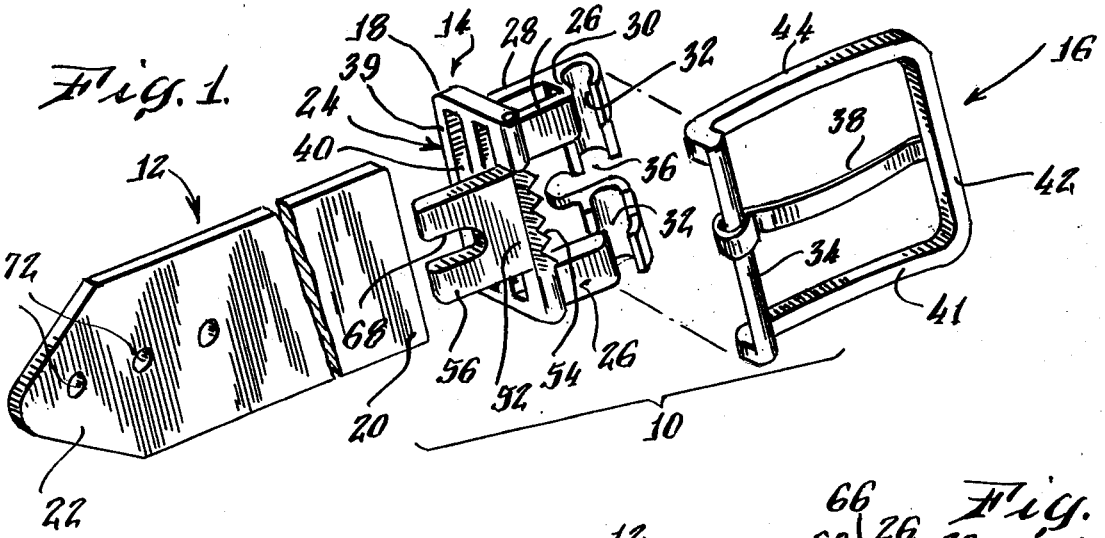
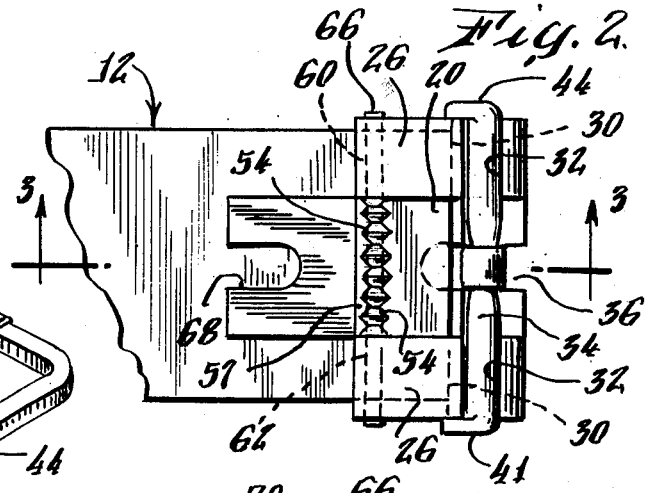
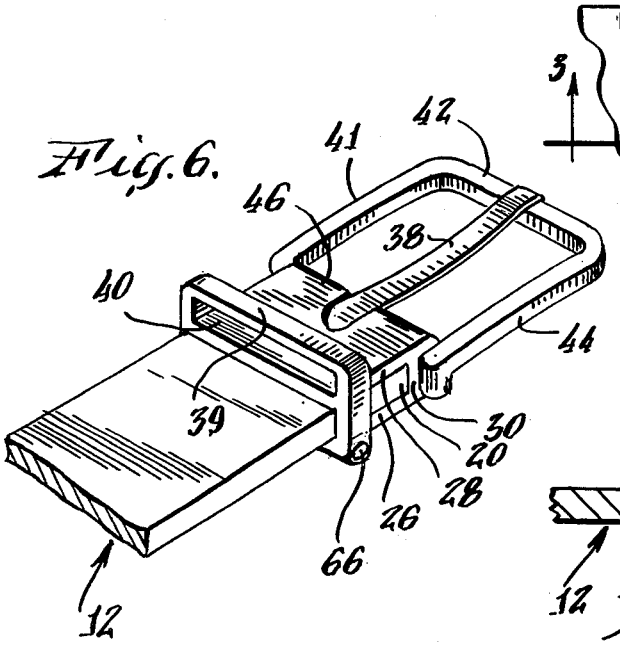
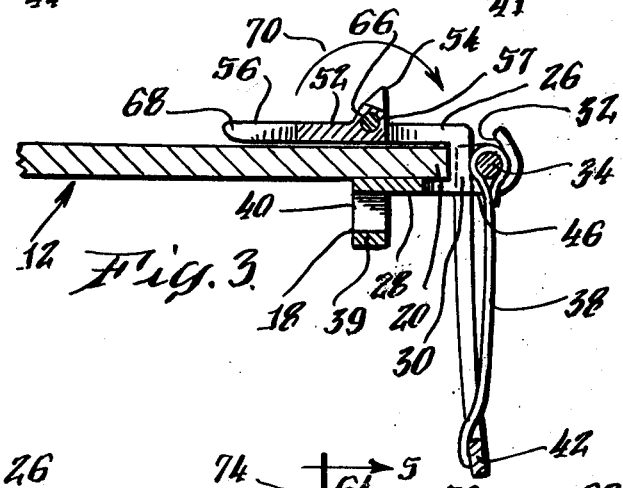
Fig. 3.
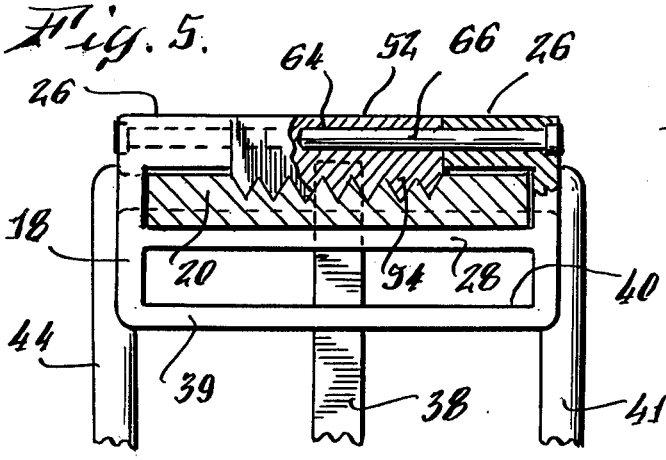
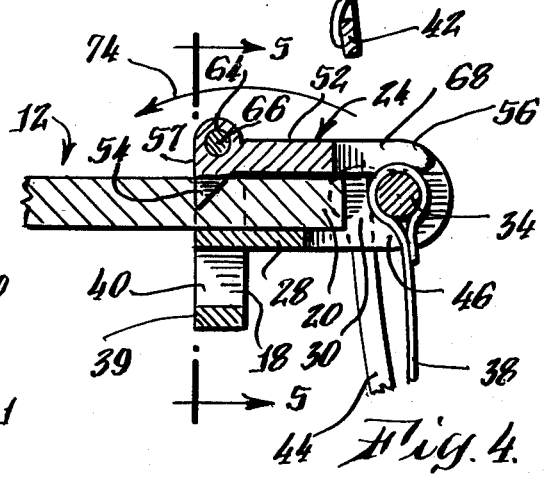
Fig. 4.

DEMOUNTABLE BELT BUCKLE

BACKGROUND OF THE INVENTION

1. Field of the Invention

This invention relates to belt buckles. The invention relates particularly to an improved belt buckle of the type which is demountable from a belt strip.

2. Description of the Prior Art

It is often desirable to provide a demountable belt buckle. The demountable belt buckle is particularly useful in the men's clothing retail field where it has been the practice to stock relatively large numbers of belt sizes in order to accomodate varied consumer requirements. Use of a demountable belt buckle permits substantially less inventory while satisfying the same consumer requirements. In this case, a belt strip of a single length is provided which can be cut to the purchaser's required length prior to mounting the buckle.

In addition to the various sizes for a particular type of belt buckle, the retailer is also required to stock belts having different belt buckle designs and configurations. This again increases the overall inventory required and is costly to the retailer.

SUMMARY OF THE INVENTION

Accordingly, it is an object of this invention to provide an improved belt buckle.

Another object of the invention is to provide a demountable belt buckle having an improved means for mounting the buckle to a belt strip.

Another object of the invention is to provide a demountable belt buckle adapted to utilize interchangeable buckle tongue members.

Another object of the invention is to reduce retail belt inventory and cost.

Another object of the invention is to provide a user with an improved means for substituting belt buckles.

In accordance with the general features of the invention, an improved belt buckle comprises a retainer member and a belt gripping member. The retainer member is adapted to be demountably coupled to a belt segment and the belt gripping member is adapted to be demountably coupled to the retainer member. The retainer member includes a means for receiving and seating the belt gripping member and a manually actuated clamping means for clamping the retainer member to the belt segment and locking the belt gripping member to the first retainer member when actuated in a first direction, and, alternatively unclamping the retainer member from the belt segment and unlocking the belt gripping member from the retainer member when actuated in a second opposite direction.

BRIEF DESCRIPTION OF THE DRAWINGS

These and other objects and features of the invention will become apparent when reference to the following specification and to the drawings wherein:

FIG. 1 is a fragmentary, exploded, perspective, rear view of a belt and a belt buckle in accordance with an embodiment of this invention;

FIG. 2 is a fragmentary plan view of the belt buckle of FIG. 1 which illustrates the buckle in an unlocked attitude;

FIG. 3 is a fragmentary view taken along the line 3—3 of FIG. 2 which illustrates the buckle in an unlocked attitude;

FIG. 4 is a fragmentary, enlarged view of FIG. 3 illustrating a retainer member locked to a belt segment;

FIG. 5 is a view taken along line 5—5 of FIG. 4; and,

FIG. 6 is a perspective, front view of an assembled belt buckle and belt.

DETAILED DESCRIPTION

Referring now to the drawings, a two piece buckle 10 for use with a belt 12 comprises a retainer member 14 and a belt gripping member 16. The retainer member 14 is formed by a body 18 having integrally formed therein a means for receiving and gripping a first end segment 20 of the belt 12, a means for receiving and seating the belt gripping member 16 and a keeper means for retaining a second opposite end 22 of the belt 12. The means for receiving the belt segment 20 comprises a slot 24 which is formed by first and second, parallel-aligned wall members 26 and 28, respectively and a third wall member 30 which connects the first and second wall members and forms a stop for advancing movement of the belt segment 20 in the slot 24. A means for receiving and seating the belt gripping member 16 comprises an elongated channel 32 for receiving a segment 34 of the belt gripping member 16. Channel 32 is positioned adjacent the third wall member 30. In the preferred embodiment illustrated, the channel 32 has a curvilinear cross sectional configuration which conforms in part with a curvilinear cross sectional configuration of the segment 34 of belt gripping member 16 thereby enabling the segment 34 to rotate in the channel 32 when it is seated therein. A slot 36 is formed in the channel to receive and enable rotary movement therein of a belt gripping tongue member 38 which is rotatably mounted to the segment 34 of the belt gripping member 16. The keeper means comprises an integrally formed C shaped segment 39 which with the second wall segment 28 provides a second slot 40 for restraining the end segment 22 of the belt 12.

Belt gripping member 16 includes a plurality of integrally formed side segments 41, 42 and 44 which along with the integrally formed segment 34 provide a generally frame-shaped configuration. Segment 34 is offset in a transverse direction from a plane of the segments 41, 42 and 44 by about the thickness of the body 18 in the area of the channel 32 thereby providing that the members 41, 42 and 44 are substantially flush with a surface 46 of the exposed, front side of the buckle 10. While a frame-shaped belt gripping member 16 having a rotatable tongue member 38 is illustrated, other configurations and designs including rigid tongue members may be provided.

A manually actuated clamping means is provided which both clamps the retainer member 14 to the belt segment 20 and locks the belt gripping member 16 to the retainer member 14 with a single motion when manually rotated in a first direction, and, unclamps the retainer member and unlocks the belt gripping member with a single motion when manually actuated in a second opposite direction. The clamping means comprises a pivotally mounted locking member 52 having an array of sawtooth-shaped gripping teeth 54 and a planar, elongated, integrally formed segment 56. Gripping teeth 54 are located at a pivotally mounted end 57 of the member 52 and extend transversely to a plane of the segment 56. Locking member 52 is positioned in an aperture 58 which is formed in the first wall member 26 of the retainer member 14 so that the teeth 54 are adjacent the slot 24 and the elongated segment 56 can be positioned adjacent to channel 32. Pivotal mounting of the locking member 52 is provided by first and second bores 60 and 62, respectively which are formed in the first wall member 26 on opposite sides of the aperture 58, a bore 64 formed near the end 57 of the locking member 52 adjacent the gripping teeth 54 and a pin 66 extending through the bores 60, 62 and 64. A slot 68 is formed in the elongated segment 56 of the locking member 52 and is aligned with the tongue member 38 to enable rotary motion of the tongue member 38 in the channel 32 when the segment 56 overlays the channel, as illustrated in FIG. 4.

The buckle 10 and belt 12 are assembled with the locking member in an unclamped attitude, as illustrated in FIG. 3, by inserting the belt segment 20 into the slot 24 and advancing it until further movement is restricted by the wall segment 30. The segment 34 of the gripping member 16 is then manually seated in the channel 32. This sequence can be reversed. Locking member 52 is then manually rotated with finger force in a first rotary direction as indicated by the arrow 70, FIG. 3. This rotation causes the array of sawtooth-shaped gripping teeth 54 to penetrate and grip the belt segment, and, causes the elongated segment 56 of the locking member 52 to overlay the segment 34 in the channel 32. Locking member 52 will remain in this attitude as a result of the relatively firm gripping forces exerted between the belt segment 20 and the gripping teeth 54. The belt is thus firmly clamped by the teeth of the locking member while the gripping member 16 is locked in the channel by the segment 56 of the locking member which overlays the channel 32. After clamping, any forces acting on the belt which may tend to cause withdrawal of the belt from the retainer member 14 will operate on the locking member to cause the locking member to rotate in the direction 70 thus enhancing clamping and inhibiting release of the belt. When the belt is fitted on a user, the tongue member 38 engages an aperture 72 of the belt end 22. The extending segment 22 of the belt is positioned in the keeper slot 40 and is thereby restrained. Disassembly is accomplished by manually rotating the locking member with finger force in a second opposite direction as represented by the arrow 74 in FIG. 4. The user's finger nail is placed in a small slot 76 extending between the segment 56 and a wall forming the channel 32. The elongated segment 56 provides a lever arm for rotating the teeth 54 out of gripping engagement with the belt segment 20.

An improved demountable belt buckle has thus been described. The buckle is advantageous in that it can be readily mounted and demounted and provides for substitution of different belt gripping members. A user can advantageously employ the buckle with two-sided belts and with belt gripping members of different design. The retailer advantageously can substantially reduce his inventory since a belt strip of single length can be stocked; a belt keeper is provided as an integral member of the buckle and need not be provided on a belt strip; and belt gripping members of various design can be provided for use with the same belt retainer member. There is an overall economy to both the user and retailer for the many variations possible.

While there has been described a particular embodiment of the invention, it will be apparent to those skilled in the art that variations may be made thereto without departing from the spirit of the invention and the scope of the appended claims.

What is claimed is:

1. An improved belt buckle comprising:

a. a retainer member adapted to receive and to be demountably coupled to a belt segment;

b. a belt gripping member adapted to be demountably coupled to said retainer member;

c. said belt gripping member having a mounting segment;

d. said retainer member comprising a body having a slot formed therein for receiving a belt segment and providing a stop for limiting entry of said belt segment, said slot formed by integral first and second parallel aligned wall members and an integral third wall member coupled between said first and second wall members, said stop provided by said third member;

e. said retainer member body having an elongated channel positioned adjacent said third wall member for receiving said mounting segment of said belt gripping member;

f. a central aperture formed in said first wall member;

g. a locking member having gripping teeth and an elongated actuating segment;

h. means pivotally supporting said locking member in said aperture for manually, rotatably actuating said gripping teeth into engagement with a belt segment positioned in said slot and simultaneously advancing said elongated actuating segment to said channel for overlaying said channel when actuated in a first direction whereby said belt gripping member is locked to said retainer member and said belt is gripped by said teeth, and, alternatively simultaneously unclamping said retainer member from said belt segment and unlocking said belt gripping member when said locking member is actuated in a second, opposite direction.

2. The improved belt buckle of claim 1 wherein said first and second wall members extend in spaced apart planes extending generally in the direction of the length of said belt segment.

3. The improved belt buckle of claim 1 wherein said gripping teeth extend in a direction normal to the length of said elongated segment.

4. The improved belt buckle of claim 1 wherein said body includes an integrally formed keeper segment for retaining an extending end of said belt.

5. The buckle of claim 4 wherein said keeper member is integrally formed for restraining a belt segment adjacent said second wall member.

* * * * *